US006337165B1

(12) United States Patent
Fujii et al.

(10) Patent No.: US 6,337,165 B1
(45) Date of Patent: Jan. 8, 2002

(54) ELECTROPHOTOGRAPHIC PHOTORECEPTOR AND PROCESS FOR PRODUCING THE SAME

(75) Inventors: Akiteru Fujii; Shinichi Suzuki, both of Kanagawa (JP)

(73) Assignee: Mitsubishi Chemical Corporation, Tokyo (JP)

( * ) Notice: Subject to any disclaimer, the term of this patent is extended or adjusted under 35 U.S.C. 154(b) by 0 days.

(21) Appl. No.: 09/625,987

(22) Filed: Jul. 26, 2000

(30) Foreign Application Priority Data

Dec. 27, 1999 (JP) ..... 11-368905

(51) Int. Cl.[7] ..... G03G 5/04
(52) U.S. Cl. ..... 430/58.05; 430/59.1; 430/133
(58) Field of Search ..... 430/59, 62, 69; 399/220

(56) References Cited

U.S. PATENT DOCUMENTS

| | | | | |
|---|---|---|---|---|
| 4,963,452 A | | 10/1990 | Kinoshita | 430/78 |
| 5,096,792 A | * | 3/1992 | Simpson et al. | 430/58 |
| 5,166,023 A | * | 11/1992 | Harada et al. | 430/62 |
| 5,306,586 A | | 4/1994 | Pai et al. | 430/58 |
| 5,824,444 A | * | 10/1998 | Kinoshita et al. | 430/59 |
| 5,834,146 A | | 11/1998 | Hoshizaki et al. | 399/159 |
| 6,002,901 A | | 12/1999 | Hoshizaki et al. | 430/59 |
| 6,110,347 A | * | 8/2000 | Arao et al. | 205/333 |

OTHER PUBLICATIONS

Patent Abstracts of Japan, 09160263 A, Jun. 20, 1997.
R.M. Schaffert, "Electrophotograohy", Focal Press, 1975, pp. 377–380.
J.W. Weigl et al, "Phthalocyanine–Binder Photoreceptors for Xerography", pp. 287–300.
T. Kitamura et al, Electrophotography The Society Journal, 1982, vol. 20, No. 2.#jf139##

*Primary Examiner*—John Goodrow
(74) *Attorney, Agent, or Firm*—Oblon, Spivak, McClelland, Maier & Neustadt, P.C.

(57) ABSTRACT

The present invention provides a negative charging electrophotographic photoreceptor, which includes an electroconductive substrate; a charge generation layer disposed on the electroconductive substrate; and a charge transport layer disposed on the charge generation layer; wherein the charge transport layer is in a homogeneous state; and wherein the charge generation layer has a light transmittance of at least 10% per micrometer of film thickness of the charge generation layer, or wherein the photoreceptor has an $E_{50}/E_{10}$ ratio in the range of 1 to 6, or wherein the charge generation layer has a light transmittance of at least 68% per micrometer of film thickness of the charge generation layer. The present invention provides methods of making and using the electrophotographic photoreceptor, and apparatuses which include the electrophotographic photoreceptor. The present invention also provides a method for optimizing an $E_{50}/E_{10}$ ratio in an electrophotographic photoreceptor to obtain S-shaped, high-γ characteristics in the electrophotographic photoreceptor. By use of the present invention, a negative charging electrophotographic photoreceptor is obtained having excellent performances with respect to digital light input (high-γ characteristics) and having a long life and high stability which make the photoreceptor suitable for repeated use.

41 Claims, 2 Drawing Sheets

ELECTROPHOTOGRAPHIC PHOTORECEPTOR AND PROCESS FOR PRODUCING THE SAME

BACKGROUND OF THE INVENTION

Field of the Invention

The present invention relates to an electrophotographic photoreceptor for use in electrophotographic apparatuses wherein a latent image is formed by exposing the electrophotographic photoreceptor to light. Although the present invention is useful in analogue and digital electrophotographic apparatuses, it is especially suitable for digital electrophotographic apparatuses, wherein a latent image is formed by exposing the electrophotographic photoreceptor to light that is based on image signals that have been converted to digital data. More particularly, this invention relates to an electrophotographic photoreceptor which gives a photodecay curve having a threshold value and in which the exposure energy required for transitions from a high to a low surface potential changes little (high-γ characteristics). The so-called "S-shape" photodecay is characterized by the occurrence of very little or no photodecay until the exposure energy reaches a particular level, at which a sharp photodecay is observed. The photodecay curve has a reverse "S" shape. High-γ characteristics are symbolized as S-shape photodecay.

Discussion of the Background

In the development of electrophotographic processes such as the Carlson process, the primary object is typically to describe an original image in an analogue manner. In order for a photoreceptor to faithfully reproduce intensity differences of an inputted light as toner density differences in a toner image, the surface potential of the photoreceptor typically decreases in proportion to the amount of light to which it exposed. Accordingly, photoreceptors typically include photosensitive materials having so-called "low-γ" characteristics. Such low-γ photoreceptors are akin to simple photoconductors, and are employed in the initial techniques of electrophotography; and these include photosensitive layers based on amorphous selenium (Se), amorphous silicon (Si) and ZnO-binder layers formed so as to akin to amorphous selenium layers.

"Functionally separated" photoreceptors have been developed, which employ separate charge generation and charge transport materials for improved charge generation efficiency and better transport efficiency. Examples of the functionally separated photoreceptors include layered photoreceptors having both charge generation and charge transport layers, and the later-developed photoreceptors having organic semiconductors.

In recent years, however, electrophotography has become increasingly linked to computers and electronic communications, and the recording techniques employed in printers and facsimile telegraphs have rapidly shifted to electrophotography. Ordinary copiers are beginning to employ a recording technique that enables image processing techniques such as reversal, cutting and blinding. Because of these recent developments, electrophotographic recording techniques are shifting from the conventional analogue recording for plain paper copiers to digital recording.

As described above, typical photoreceptors currently employed in electrophotographic devices, which are based on analogue signals, have low-γ characteristics. These low-γ photoreceptors are unsuitable for use in electrophotographic processes wherein the inputted digital light signal is outputted as a digital image, as in computer printers, digital copiers and other devices wherein the image is processed digitally. It is believed that because low-γ photoreceptors contain a conventional photosensitive material, they cannot reproduce an original digital image, since the photoreceptors faithfully form images attributable not only to the deterioration of digital signals occurring in the signaling channel extending from a computer or image processor to the electrophotographic apparatus, but also to aberrations of the optical system used for condensing a light beam for writing or forming an image of an original. Accordingly, there is a strong desire for a electrophotographic photoreceptor having both high sensitivity and high-γ characteristics.

Under these circumstances, a high-γ photoreceptor is disclosed in unexamined published Japanese patent application JP-A-1-169454. The referenced high-γ photoreceptor undesirably is a positive charging photoreceptor, that is, the polarity of the photoreceptor in a charged state is opposite to that of the charged photoreceptors employed in existing electrophotographic printers (negative charging). Accordingly, the referenced photoreceptor requires a toner or developer material that is undesirably of the opposite polarity with respect to the conventional charge, which undesirably increases the burden on apparatus development. In addition, since the referenced photoreceptor is a single layer type, the properties of the charge generation material, which is present in an outermost part of the photoreceptor, undesirably deteriorates by the action of an active gas, e.g., ozone.

JP-A-6-83077, JP-A-9-96914 and JP-A-9-160263 propose functionally separated, negative charging photoreceptors having high-γ characteristics. These photoreceptors, however, employ a specific charge transport polymeric compound, and also the charge transport layer needs to be heterogeneous, which inhibits the freedom of material selection and limits the possibility of future development and industrialization.

SUMMARY OF THE INVENTION

An object of the present invention is to provide a negative charging electrophotographic photoreceptor having high-γ characteristics, long life and high stability, which make the photoreceptor suitable for repeated use.

These and other objects have been attained by the present invention, the first embodiment of which provides a negative charging electrophotographic photoreceptor, which includes:

- an electroconductive substrate;
- a charge generation layer disposed on the electroconductive substrate; and
- a charge transport layer disposed on the charge generation layer;
  - wherein the charge transport layer is in a homogeneous state; and wherein the charge generation layer has a light transmittance of at least 10% per micrometer of film thickness of the charge generation layer.

Another embodiment of the invention provides a negative charging electrophotographic photoreceptor, which includes:

- an electroconductive substrate;
- a charge generation layer disposed on the electroconductive substrate; and
- a charge transport layer disposed on the charge generation layer;

wherein the charge transport layer is in a homogeneous state; and wherein the photoreceptor has an $E_{50}/E_{10}$ ratio in the range of 1 to 6.

Another embodiment of the invention provides a negative charging electrophotographic photoreceptor, which includes:

an electroconductive substrate;

a charge generation layer disposed on the electroconductive substrate; and a charge transport layer disposed on the charge generation layer;

wherein the charge transport layer is in a homogeneous state; and wherein the charge generation layer has a light transmittance of at least 68% per micrometer of film thickness of the charge generation layer.

Another embodiment of the invention provides a process for producing the electrophotographic photoreceptor of the invention, which includes solvent coating the charge transport layer onto the charge generation layer, wherein the charge generation layer is insoluble in the solvent.

Another embodiment of the invention provides an electrophotographic apparatus, which includes the electrophotographic photoreceptor of the invention.

Another embodiment of the invention provides a method of forming an image, which includes exposing the electrophotographic photoreceptor of the invention to light.

Another embodiment of the invention provides a method for optimizing an $E_{50}/E_{10}$ ratio in an electrophotographic photoreceptor to obtain S-shaped, high-γ characteristics in the electrophotographic photoreceptor, the electrophotographic photoreceptor including:

an electroconductive substrate;

a charge generation layer disposed on the electroconductive substrate and containing a charge generation material and a binder resin; and a charge transport layer disposed on the charge generation layer and containing a charge transport material and a binder resin;

which process includes correlating the following factors:

charge generation material;

concentration of charge generation material;

binder resin in the charge generation layer;

charge transport material;

concentration of charge transport material; and binder resin in the charge transport layer.

Another embodiment of the present invention provides an electrophotographic apparatus, which includes:

an electrophotographic photoreceptor; and an exposure light, wherein the electrophotographic photoreceptor includes:

an electroconductive substrate;

a charge generation layer disposed on the electroconductive substrate; and a charge transport layer disposed on the charge generation layer;

wherein the charge transport layer is in a homogeneous state; and wherein the charge generation layer includes a light transmittance to the exposure light of at least 10% per micrometer of film thickness of the charge generation layer.

Another embodiment of the present invention provides a method of forming an image, which includes exposing the above electrophotographic photoreceptor to the exposure light.

DETAILED DESCRIPTION OF THE INVENTION

Figure 1:
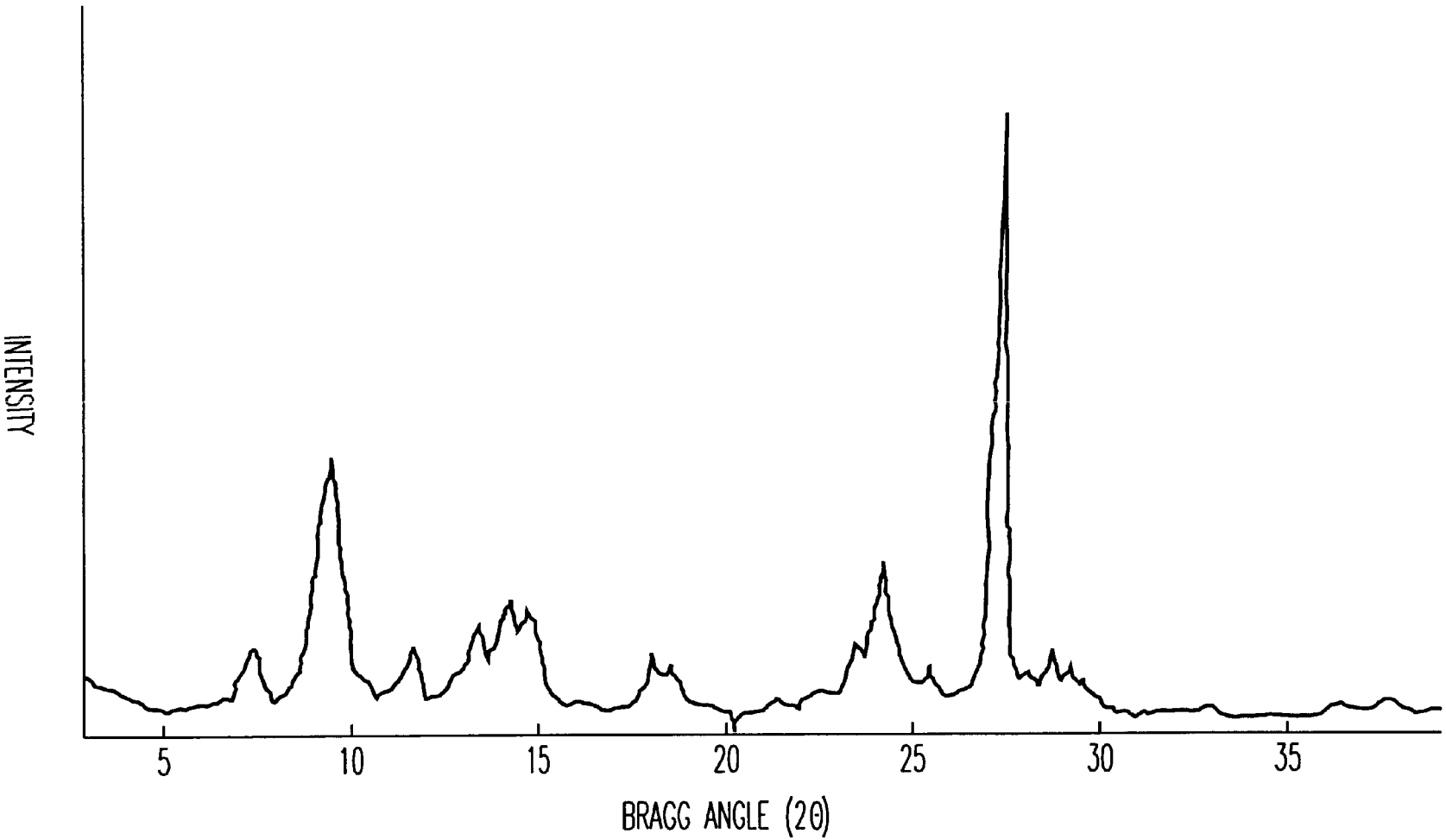
FIG. 1 is an X-ray powder diffraction pattern of the oxytitanium phthalocyanine used in Comparative Example 1.

Various other objects, features and attendant advantages of the present invention will be more fully appreciated as the same becomes better understood from the following detailed description of the preferred embodiments of the invention.

The photoreceptor layer of the present invention is preferably a multilayer structure that includes a charge generation layer and a charge transport layer which have been formed, preferably in this order, on an electroconductive substrate. The multilayer structure may have an intermediate layer such as an undercoating layer, and/or transparent insulating layer, and the multilayer structure also may have a surface protective layer, etc. according to need as long as the performance of the photoreceptor is not deteriorated.

The preferable constitution of each layer will be explained below in detail.

Preferable examples of the electroconductive substrate include metallic materials such as aluminum, stainless steel, copper, nickel, zinc, indium, gold, silver, and alloys of these, polymers such as polyesters, and substrates obtained by forming an electroconductive layer made of, e.g., aluminum, copper, palladium, tin oxide, indium oxide, or an electroconductive polymer on a surface of an insulating base, e.g., paper or a grass. The surface of the electroconductive substrate can be subjected to various treatments such as, e.g., an oxidation treatment and a chemical treatment as long as these treatments do not exert an adverse influence on image quality. Preferable examples of such treated substrates include metal substrates which have undergone oxidation by an electrode oxidation, etc. The electroconductive substrate can have any desired shape such as, e.g., a drum, sheet, belt, or seamless belt.

Preferably, the charge generation layer is composed mainly of a charge generation material and a binder polymer.

Preferable examples of the charge generation material include selenium and alloys thereof, arsenic-selenium, cadmium sulfide, zinc oxide, cadmium sulfide, zinc sulfide, antimony sulfide, alloys such as CdS—Se, oxide semiconductors such as titanium oxide, silicon materials such as amorphous silicon, other inorganic photoconductive substances, and various organic pigments and dyes such as phthalocyanines, azo dyes, quinacridone, polycyclic quinones, pyrylium salts, perylene, indigo, thioindigo, anthoanthrone, pyranthrone, and cyanines. Preferred of these are organic pigments and dyes. Especially preferred are polycyclic quinones, perylene, phthalocyanines, and azo pigments. Preferred examples of the phthalocyanines include metal-free phthalocyanine and the phthalocyanine containing coordinated thereto either a metal, e.g., copper, indium, gallium, silicon, tin, titanium, zinc, or vanadium, or an oxide, chloride, or hydroxide of such a metal. Preferred examples of the azo pigments include monoazo, bisazo, trisazo, and polyazo pigments. These charge generation materials can be used alone or in combination of two or more thereof. Charge generation materials having an average particle diameter of 1 μm or smaller are preferred; more preferably 0.75 μm or smaller; more particularly preferably 0.25 μm or smaller; and most preferably 0.1 μm or smaller.

The charge generation layer can be obtained by dissolving or dispersing any of these charge generation materials in a solvent or a dispersion medium together with a binder polymer, applying the resultant coating fluid on a substrate, drying the coating, and optionally heating the coating film to cure it. Preferable examples of the binder polymer include homopolymers and copolymers of vinyl compounds such as butadiene, styrene, vinyl acetate, vinyl chloride, acrylic esters, methacrylic esters, vinyl alcohol, and ethyl vinyl ether, poly(vinyl butyral), poly(vinyl formal), partially modified poly(vinyl acetal)s, polycarbonates, polyesters, polyamides, polyurethanes, cellulose ethers, phenoxy resins, siliconeresins, epoxyresins, and poly(N-vinylcarbazole) resins. Curable resins may be used, which are resins undergoing polymerization or crosslinking by the action of heat, light, radiation, etc. These binders can be used alone or in combination of two or more thereof. When a curable resin is used to form a charge generation layer having a tenacious network structure, it is possible to subsequently form a charge transport layer without permitting a low-molecular weight compound used for forming the charge transport layer to penetrate into the charge generation layer. Preferred examples of such a heat curable or radio curable resin include urethane resins, unsaturated polyester resins, epoxy resins, thermosetting acrylic resins, alkyd resins, silicone resins, melamine resins, thermosetting phenolic resins, phenoxy resins, thermosetting fluororesins, silicone-alkyd resins, phenol-formaldehyde resins, styrene-alkyd resins, urea resins, and polyimide resins. Preferable examples of such a photocurable resin include unsaturated polyesters, acrylic resins, acrylic-modified alkyd resins, polyester acrylates, polyether acrylates, acrylic modified epoxy resins, acrylic-modified polyurethanes, acrylic-modified spiran resins, acrylic-modified silicone resins, polythiol resins, and cationically polymerizable epoxy resins. It is preferred to use at least one resin selected from unsaturated polyester resins, epoxy resins, melamine resins, urethane resins, curable fluororesins, acrylic resins, and photocurable resins.

Preferred examples of the solvent or dispersion medium used for coating include amines such as butylamine, diethylamine, ethylenediamine, isopropanolamine, triethanolamine and, triethylenediamine; amides such as N,N-dimethylformamide; ketones such as acetone, methyl ethyl ketone and cyclohexanone; aromatic hydrocarbons such as benzene, toluene and xylene; halogenated hydrocarbons such as chloroform, 1,2-dichloroethane, 1,2-dichloropropane, 1,1,2-trichloroethane, 1,1,1-trichloroethane, trichloroethylene, tetrachloroethane and dichloromethane; cyclic ethers such as tetrabydrofuran and dioxane; alcohols such as methyl alcohol, ethyl alcohol and isopropyl alcohol; esters such as ethyl acetate and butyl acetate; sulfoxides such as dimethyl sulfoxide; and ethers such as methyl Cellosolve. These solvents may bo used alone or es a mixed solvent composed of two or more thereof.

Preferable examples of the solvent or dispersion medium are ketones, aromatic hydrocarbons and cyclic ethers, and more preferable examples are methyl ethyl ketone, cyclohexanone, toluene, xylene, tetrahydrofuran and dioxane.

Preferably, a charge generation material is dissolved in an appropriate solvent or dispersed in an appropriate dispersion medium usually with a ball mill, ultrasonic dispersing device, paint shaker, attritor, sand grinder, or the like, and a binder polymer is added thereto to prepare a coating fluid. Preferably, this coating fluid is applied to a substrate by a coating technique such as, e.g., dipping, spraying, bar coating, blade coating, roll coating, wire bar coating, or knife coating, and then dried and optionally cured.

In order to impart satisfactory S-shaped, high-γ characteristics to the photoreceptor, the charge generation layer preferably not only generates charges efficiently but also transmits light to inner parts thereof close to the substrate to enable those parts to generate charges. In order for the charge generation layer to satisfy the above requirement, it has a light transmittance of preferably 10% or higher, more preferably 30% or higher, more particularly preferably 60% or higher, more especially preferably 68% or higher, most preferably 75% or higher, most particularly preferably 80% or higher, and most especially preferably 85% or higher per micrometer of the film thickness thereof as measured at the wavelength of the exposure light to be used in an electrophotographic apparatus. Conventional charge generation layers typically have light transmittances of less than about 1%.

The charge generation material is preferably present in an amount of greater than zero to 40 parts by weight, more preferably 10 to 35 parts by weight, more particularly preferably 15 to 30 parts by weight, and most preferably 20 to 25 parts by weight, per 100 parts by weight of the binder polymer. When the content of the charge generation material is too high, light transmission is reduced, making it difficult to obtain the effects of the present invention. The charge generation layer is preferably thicker than a charge generation layer of the conventional photoreceptors, corresponding to the higher transmittance. The thickness of the charge generation layer is preferably 1 μm or larger, more preferably from 1.1 μm to 20 μm, more particularly preferably from 1.2 μm to 10 μm, more especially preferably 1.3 μm to 8 μm, most preferably 1.4 μm to 6 μm, and most particularly preferably 1.6 μm to 4 μm. These ranges include all values and subranges therebetween, including 0.5 μm, 0.7 μm, 2.1 μm and 6.5 μm.

The charge transport layer preferably includes a charge transport agent. Preferable examples thereof include polymer compounds such as polyvinylcarbazole, polyvinylpyrene, polyacenaphthylene, polyvinylpyrene, and polyvinylanthracene; and low-molecular weight compounds such as various pyrazoline derivatives, carbazole derivatives, oxazole derivatives, hydrazone derivatives, stilbene derivatives, arylamine derivatives, oxadiazole derivatives, thiazole derivatives, thiadiazole derivatives, triazole derivatives, imidazole derivatives, imidazolone derivatives, imidazolidine derivatives, styryl compounds, benzothiazole derivatives, benzimidazole, acridine derivatives, and phenazine derivatives. Besides the above charge transport agents of the hole transport type, electron transporting agents can also be used according to need, such as, e.g., benzoquinone derivatives, naphthoquinone derivatives, anthraquinone derivatives, diphenoquinone derivatives, and fluorenone derivatives. These charge transport agents may be used alone or in combination of two or more thereof, while taking account of the suitability thereof for the charge generation material to be used.

Wherein when the charge transport agent has poor film-forming properties, a binder polymer is preferably used in the charge transport layer. Preferably, the charge transport layer is formed by dissolving the charge transport agent and the binder polymer in a solvent, applying the resultant coating fluid on the charge generation layer, and drying the coating. In the charge transport layer thus obtained, the charge transport material or the like is homogeneously compatibilized with the binder resin. Preferable examples of the binder polymer and solvent are the same as those enumerated hereinabove with regard to the charge generation layer. In forming the charge transport layer, the same coating techniques as those usable for forming the charge generation layer can be used.

The homogeneous state, which is used as a charge transport layer of the homogeneous state, preferably means the state in which the heterogeneous part derived from the charge transport material or the binder polymer cannot be seen using a scanning transmission electron microscope or transmission electron microscope with a magnification of 10,000 to 100,000 to observe the cross area and the surface of charge transport layer, which may be colored if necessary. In the charge transport layer, fine particles such as polytetrafluorethylene, stylene and silica may be dispersed in order to improve mechanical property. The fine particles can form the heterogeneous part. Therefore, the area of heterogeneous part in total is preferably 10% or less using the scanning transmission electron microscope or transmission electron microscope with magnification of 25,000; more preferably 8% or less; more particularly preferably 5% or less; and most preferably 3% or less.

In forming the charge transport layer, it is preferable to select conditions such that the charge transport material does not substantially penetrate into the charge generation layer. Accordingly, it is preferred to use coating, drying and curing techniques in which the charge generation layer does not swell or dissolve in the solvent used for forming the charge transport layer.

No substantial penetration preferably means that the charge transport material in the charge generating layer does not substantially affect the state of the charge transport in the charge generation layer.

This can be detected by analyzing the content of the charge transport material of the charge generating layer by conventional analysis technology.

In order to achieve the preferable effect imparted by the state in which the charge transport material does not substantially penetrate into the charge generation layer, it is preferable to:

(i) select the proper combination of the binder polymer of the charge generation layer, the binder polymer of the charge transport layer and the solvent for coating, and select the condition of coating, drying and curing so as not to dissolve the binder polymer in the coating solvent of charge transport layer and not to swell the charge generation layer by coating, drying and curing of the charge transport layer, (ii) apply a curable resin to the binder polymer of the charge generation layer and form the charge transport layer after curing treatment of the charge generation layer, and (iii) form the charge generation layer thick enough not to be influenced by he penetration of the charge transport material into the charge generation layer.

In (iii), higher light transmittance of the charge generation layer is preferable because the whole layer can contribute to the charge generation. When the charge generation layer has lower light transmittance, only the surface part of the layer can contribute to the charge generation, and it would be inefficient to obtain the effect.

In the charge transport layer, the proportion of the charge transport agent to the binder polymer is not particularly limited. However, the use amount of the binder polymer is preferably from 10 to 500 parts by weight, more preferably from 30 to 300 parts by weight, per 100 parts by weight of the charge transport agent. The thickness of the charge transport layer is preferably from 10 to 100 $\mu$m, more preferably from 15 to 50 $\mu$m and most preferably from 20 to 40 $\mu$m.

Preferably, an electron withdrawing compound, a dispersant, a surfactant, plasticizers, antioxidants, ultraviolet absorbers and leveling agents and other additives may be optionally added to the charge generation layer and the charge transport layer so as to be improved in film-forming properties, flexibility, applicability, mechanical strength, durability, etc.

Preferable examples of the electron-withdrawing compound include cyano compounds such as tetracyanoquinodimethane, dicyanoquinomethane, and aromatic esters having a dicyanoquinovinyl group; nitro compounds such as 2,4,6-trinitrofluorenone; fused polycyclic aromatic compounds such as perylene; diphenoquinone derivatives; quinones; aldehydes; ketones; esters; acid anhydrides; phthalide and derivatives thereof; metal complexes of optionally substituted salicylic acid; metal salts of optionally substituted salicylic acid; metal complexes of aromatic carboxylic acids; and metal salts of aromatic carboxylic acids. Preferred of these are cyano compounds, nitro compounds, fused polycyclic aromatic compounds, diphenoquinone derivatives, metal complexes of optionally substituted salicylic acid, metal salts of optionally substituted salicylic acid, metal complexes of aromatic carboxylic acids, and metal salts of aromatic carboxylic acids.

It is a matter of course that the electrophotographic photoreceptor of the present invention may optionally have an undercoating layer, a transparent insulating layer, a surface protective layer, etc.

The undercoating layer is preferably interposed between the photosensitive layers and the electroconductive substrate. For forming the undercoating layer, known materials generally used for undercoating can be used. Preferable examples of the undercoating layer include: (i) a layer formed by merely ruminating fine inorganic particles, e.g., titanium oxide, aluminum oxide, zirconia, or silicon oxide particles, or fine organic particles; (ii) a layer of a resin such as a polyamide resin, phenolic resin, melamine resin, casein, polyurethane resin, epoxy resin, cellulose, nitrocellulose, poly(vinyl alcohol), or poly(vinyl butyral); and a layer that includes the resin layer (ii) containing, dispersed therein, fine particles for use in the layer (i). These finely particulate materials and resins may be used alone or as a mixture of two or more thereof. The thickness of the undercoating layer is preferably from 0.01 to 50 $\mu$m, more preferably from 0.01 to 10 $\mu$m. A known blocking layer may be formed between the photosensitive layers and the electroconductive substrate.

In the case where a surface protective layer is formed on the photoreceptor of the present invention, the thickness of the protective layer is preferably from 0.01 to 20 $\mu$m, more preferably from 0.1 to 10 $\mu$m. Any of the aforementioned binder polymers can be used for forming the protective layer. The protective layer may contain any of the aforementioned charge generation materiels, charge transport agents, and additives and other ingredients including electroconductive materials, such as metals and metal oxides, and lubricants.

The electrophotographic photoreceptor thus obtained is suitable for use in the field of electrophotography such as copiers, printers, facsimile telegraphs, and plate making machines. Although the present invention is suitable for both analog and digital applications, it is especially suited for digital applications.

For charging the electrophotographic photoreceptor of the present invention, use is made of a charging device such as a corona charging device, e.g., a corotron or scorotron, a contact charging device, e.g., a charging roll or charging brush, or the like. For exposure, use is made of a halogen lamp, fluorescent lamp, laser (semiconductor or He—Ne laser), LED, or the like or a technique of internally exposing the photoreceptor. However, lasers, LEDs, and illuminators employing a light shutter array are preferred for digital electrophotographic apparatuses.

Preferably, in the electrophotographic photoreceptor of the invention, the light transmittance is measured with a light that discharges the surface potential of the negatively charged photoreceptor.

More preferably, in the electrophotographic photoreceptor of the invention, the light transmittance is measured with a light that decreases the surface potential of the photoreceptor to at least half of the initial potential of the negatively charged photoreceptor.

Most preferably, in the electrophotographic photoreceptor of the invention, the light transmission is measured with a light that decreases the surface potential of the photoreceptor to at least half of the initial surface potential when initially charged at −6.0 kV of the surface of the photoreceptor.

The wavelength of an exposure light is not limited to the conventional wavelength of 780 nm, but may also be selected from any wavelength from 400~800 $\mu$m, inclusive. By exposing the photoreceptor of the present invention to a light having a wavelength in such a specific region that the charge generation layer has a transmittance of preferably 10% or higher, more preferably 30% or higher, more particularly preferably 60% or higher, more especially preferably 68% or higher, most preferably 75% or higher, most particularly preferably 80% or higher, and most especially preferably 85% or higher per micrometer of the film thickness thereof, satisfactory high-$\gamma$ characteristics can be obtained.

A development step is conducted, for example, by a dry development technique, such as cascade development, development with a one-component insulating toner, development with a one-component conductive toner, or magnetic brush development with a two-component developer material, or by a wet development technique.

A transfer step is conducted by the electrostatic transfer method, such as corona transfer, roller transfer, or belt transfer, the press transfer method, or the pressure-sensitive adhesive transfer method. Fixing is conducted, for example, by heated-roller fixing, flash fixing, oven fixing, or press fixing. For cleaning is used a brush cleaner, magnetic brush cleaner, electrostatic brush cleaner, magnetic roller cleaner, blade cleaner, or the like.

The thus-obtained photoreceptor of the present invention has the following unique photoresponsive properties unlike conventional photoreceptors. It can hence be used as a photoreceptor for a digital light input.

As stated hereinabove, conventional photoreceptors have a photoresponse that changes nearly linearly with the quantity of input light (logarithm thereof). Namely, the conventional photoreceptors undergo some degree of surface potential decay even with a small quantity of light. In contrast, the photoreceptor of the present invention undergoes no or little photoresponse when the quantity of input light is smaller than a given value, and abruptly responds to the light immediately after the light quantity exceeds the given value. Since digital recording is a technique in which image gradation is attained with various dot areas, it is preferred to employ in this recording technique a photoreceptor having the photoresponsive properties possessed by the photoreceptor of the present invention. This is because even when a laser spot is accurately modulated with an optical system, the spot itself unavoidably has a distribution of light quantity or a halo due to the principle. Consequently, the conventional photoreceptors, in which the photoresponse occurs gradationally according to the change of light energy (quantity of input light), give different dot patterns with changing light quantity to produce noises, which undesirably cause fogging. The photoreceptor of the present invention is hence suitable for digital light input. $E_{50}/E_{10}$, the ratio of the exposure amount $E_{50}$ required for a surface potential of the charged photoreceptor to undergo a 50% decay to the exposure amount $E_{10}$ required therefor to undergo a 10% decay, expresses the S-shaped high-$\gamma$ response characteristics. According to a preferred embodiment of the invention, $E_{50}/E_{10}$ of the electrophotographic photoreceptor is preferably 1–6, more preferably 1–5, and most preferably 1–4 in view of practical use.

The mechanism of producing such S-shaped high-$\gamma$ response characteristics has not yet been fully elucidated. However, D. M. Pai et al. have reported that for the charge transport step the presence of wound conduction paths is important which are charge transport paths distributed unevenly with respect to the direction of an electric field and having local parts with a high barrier (see U.S. Pat. No. 5,306,586, the entire contents of which are hereby incorporated by reference). Due to such conduction paths, the charges which have generated upon exposure in a light energy smaller than a given value cannot fully move to eliminate surface charges. However, when the quantity of exposure light reaches the given value, considerable charge movement abruptly comes to occur. It is presumed that such wound conduction paths are present in the charge generation layer of the photoreceptor of the present invention. Consequently, if most of an exposure light is absorbed by an upper part of the charge generation layer, the charges which have generated move to the charge transport layer while hardly passing through the wound conduction paths. On the other hand, under such conditions that an exposure light reaches to a lower part of the charge generation layer, i.e., to a part close to the substrate, the charges which have generated fully move through the wound conduction paths in the charge generation layer, whereby the S-shaped high-$\gamma$ response characteristics are thought to be produced. Possible measures for enabling an exposure light to reach to a lower part of the charge generation layer, i.e., to a part close to the substrate, include to reduce the proportion of the charge generation material contained in the charge generation layer to the binder resin, to employ a charge generation material showing reduced absorption of the exposure light to be used, and to employ an illuminator emitting a light having a wavelength in a region where absorption by the charge generation material is weak.

The electrophotographic photoreceptor of this invention is preferably used, for example, both for an electrophotographic apparatus in which the electrophotographic photoreceptor is irradiated with a monochromatic light to form an electrostatic latent image and a digital electorophotographic apparatus which forms an image through the step of forming a latent image by exposing an electrophotographic photoreceptor to a monochromatic light which is based on an image signals which have been converted to digital data.

The transmittance of the monochromatic light is preferably 10% or higher, more preferably 30% or higher, more particularly preferably 60% or higher, more especially preferably 68% or higher, most preferably 75% or higher, most particularly preferably 80% or higher, and most especially preferably 85% or higher per micrometer of film thickness of said charge generation layer.

An especially preferred embodiment of the invention relates to an electrophotographic apparatus and method in which the electrophotographic photoreceptor of the present invention is irradiated with a monochromatic light to form an electrostatic latent image, the monochromatic light having a wavelength such that the charge generation layer has a light transmittance of 68% or higher per micrometer of the film thickness of the charge generation layer.

Another especially preferred embodiment of the invention relates to an electrophotographic apparatus and method in which an image is formed through the step of forming a latent image by exposing the electrophotographic photoreceptor of the present invention to light based on image signals that have been converted to digital data.

EXAMPLES

Having generally described this invention, a further understanding can be obtained by reference to certain specific examples which are provided herein for purposes of illustration only and are not intended to be limiting unless otherwise specified.

Comparative Examples 1

(Formation of Charge Generation Layer)

Ten parts of oxytitanium phthalocyanine giving the X-ray powder diffraction pattern with $CuK_\alpha$ shown in FIG. 1 was mixed with 5 parts of poly(vinyl butyral) (trade name, #6000-C; manufactured by Denki Kagaku Kogyo K.K.) and 500 parts of 1,2-dimethoxyethane. This mixture was treated with a sand grinding mill to pulverize and disperse the solid ingredients. Thus, a coating fluid for charge generation layer formation was obtained.

Subsequently, an electroconductive substrate consisting of a 75 $\mu$m-thick polyester film coated with vapor-deposited aluminum was coated with the coating fluid for charge generation layer formation by means of a wire-wound bar in an amount of 0.4 g/m$^2$ (about 0.4 $\mu$m) on a dry basis. The coating was dried to form a charge generation layer.

(Formation of Charge Transport Layer)

A coating fluid prepared by dissolving 63 parts of the charge transport material (CTM) shown below,

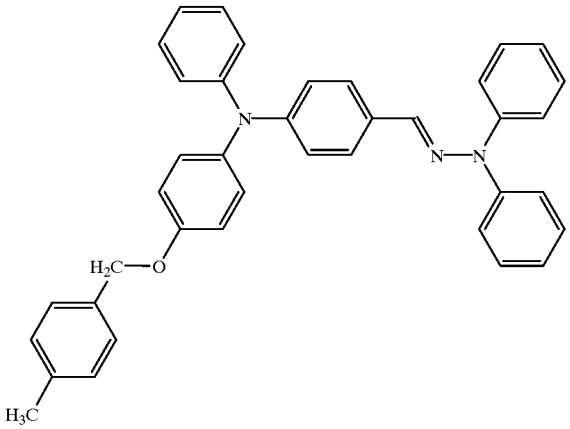

7 parts of the following CTM,

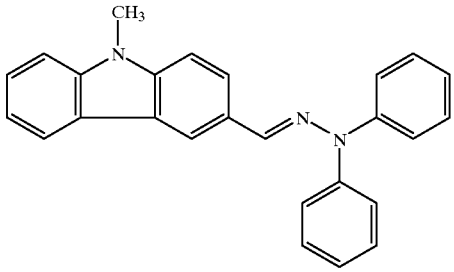

and 100 parts of a polycarbonate resin (trade name, Z-200; manufactured by Mitsubishi Gas Chemical Company, Inc.) in a tetrahydrofuran/dioxane mixed solvent was applied on the charge generation layer with an applicator. Thereafter, the coaling was dried first at room temperature for 30 minutes and then at 125° C. for 20 minutes to form a charge transport layer having a thickness of 24 $\mu$m on a dry basis. This electrophotographic photoreceptor is referred to as P1.

Example 1

(Formation of Charge generation Layer)

A phthalocyanine composition was synthesized by the following method.

In 440 g of methanesulfonic acid were dissolved, with sufficient stirring, 40 g of copper phthalocyanine produced from phthalic anhydride, cupric chloride, and urea by the Wheeler method and 0.8 g of tetranitro copper phthalocyanine produced using 4-nitrophthalic anhydride by the same method. The resultant solution was poured into 2,000 g of water to precipitate a composition. This precipitate was taken out by filtration, washed with water, and then dried at 60° C. to obtain 39.8 g of a copper phthalocyanine composition.

This composition was used to obtain a coating fluid according to the following formulation (amount of the copper phthalocyanine composition: 5 parts by weight per 100 parts by weight of the binder resin).

The copper phthalocyanine composition, 0.24 g

Binder resin solution, 7.86 g

Cefural Coat A202B (manufactured by Central Glass Co., Ltd.), containing a fluororesin Curing agent, 0.88 g Isocyanate, Coronate HX (manufactured by Nippon Polyurethane Co., Ltd.)

Catalyst

Dibutyltin dilaurate, 0.12 mg

Solvent

Cyclohexanone, 26.3 g

The coating fluid having the above composition was applied to a substrate, and the coating was predried at room temperature and then dried and cured in an oven at 100° C. for 1 hour to obtain a charge generation layer having a thickness of 4.3 $\mu$m.

Subsequently, a charge transport layer was laminated on the charge generation layer by the same method as in Comparative Example 1. Thus, an electrophotographic photoreceptor A1 was obtained.

Example 2

The same procedure as in Example 1 was conducted, except that the amount of the copper phthalocyanine composition was changed to 10 parts by weight. Thus, an electrophotographic photoreceptor A2 was obtained, in which the charge generation layer had a thickness of 3.6 μm.

Example 3

The same procedure as in Example 1 was conducted, except that the amount of the copper phthalocyanine composition was changed to 25 parts by weight. Thus, an electrophotographic photoreceptor A3 was obtained, in which the charge generation layer had a thickness of 4.5 μm.

Examples 4–6

The same procedure as in Example 1 was conducted, except that 25 parts by weight of X-form metal-free phthalocyanine (trade name, Fastogen Blue 8120BS: manufactured by Dainippon Ink & Chemicals, Inc.) was used in place of the copper phthalocyanine composition. Thus, an electrophotographic photoreceptor A4 was obtained, in which the charge generation layer had a thickness of 4.3 μm.

<Evaluations of the Electrophotographic Photoreceptors>

The photoreceptors obtained in the Examples and Comparative Examples given above were evaluated with a photoreceptor tester (Cynthia 55, manufactured by GenTec Co.) for photosensitivity and suitability for repetitions of use.

First, each photoreceptor was charged by −6.0 kV corona charging. The charged photoreceptors each was irradiated with a monochromatic light having a wavelength of 780 nm in example 5 (850 nm in Example 4 and 650 nm in Example 6) at various light intensities. Thus, a photodecay-time curve (a curve showing the change in surface potential with irradiation time) was determined for each light intensity. The surface potential as measured after the lapse of a given irradiation period (0.5 sec in this evaluation) was determined from each of these curves, and the thus-obtained values of surface potential were plotted against light energy. This curve is referred to as a photodecay curve.

From the photodecay curve was determined the value of $E_{50}/E_{10}$, wherein $E_{10}$ and $E_{50}$ are the light energies required for the surface potential to decrease from the initial surface potential value by 10% and 50%, respectively. The photoreceptors having a value of $E_{50}/E_{10}$ within the following range $$1<E_{50}/E_{10}\leqq 5$$

are suitable for digital recording.

$E_{50}$ indicates the sensitivity of the photoreceptor. The smaller the value of $E_{50}$, the more the photoreceptor is sensitive and suitable for electrophotography.

In determining the transmittance of a charge generation layer, this charge generation layer was formed on a transparent polyester sheet in the same thickness as in the corresponding photoreceptor sample and then examined for transmittance.

Figure 2:
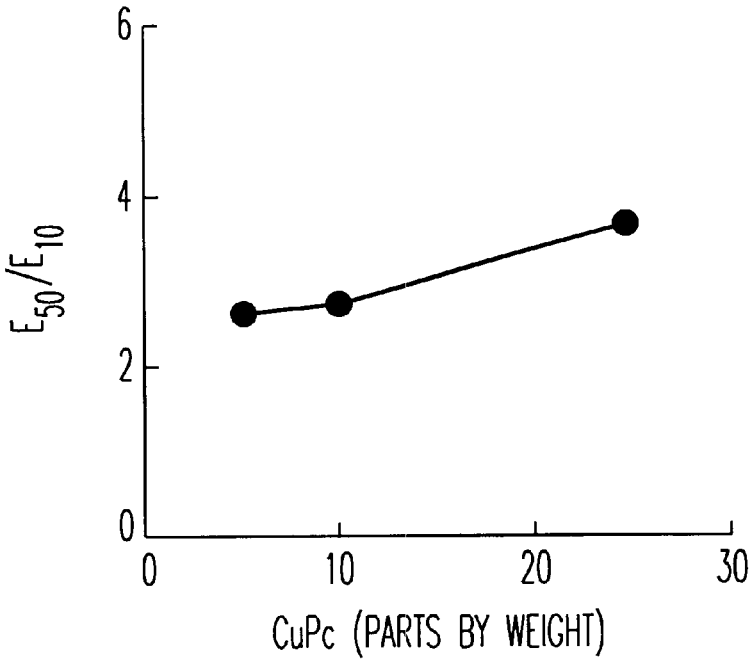
FIG. 2 is a graph showing the relationship between the amount of copper phthalocyanine (parts by weight) and $E_{50}/E_{10}$ in the electrophotographic photoreceptors obtained in Examples 1 to 3.
Figure 3:
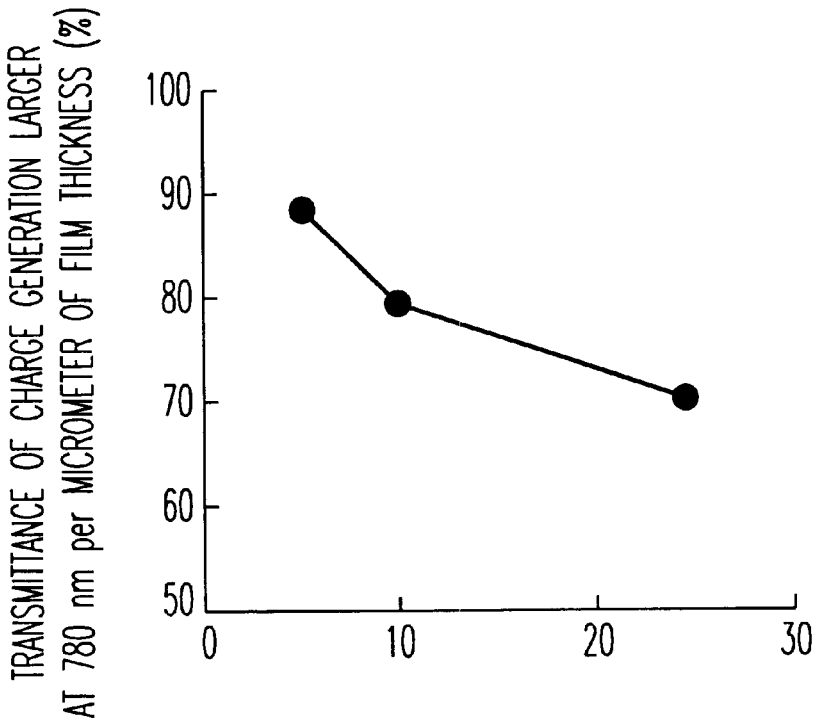
FIG. 3 is a graph showing the relationship between the amount of copper phthalocyanine (parts by weight) and the transmittance at 780 no of the charge generation layer per micrometer of the thickness thereof in the electrophotographic photoreceptors obtained in Examples 1 to 3.

The results of the above evaluations in the Examples and Comparative Examples are summarized in Table 1 and FIGS. 2 and 3.

TABLE 1

| | Photo-receptor | Composition of charge generation layer, weight ratio | Wavelength of exposure light (nm) | Transmittance per μm (%) | $E_{50}$ (μJ/cm$^2$) | $E_{10}$ (μJ/cm$^2$) | $E_{50}/E_{10}$ |
|---|---|---|---|---|---|---|---|
| Comp. Ex. 1 | P1 | TiOPc/binder = 200/100 | 780 | 3.2 | 0.16 | 0.02 | 8.0 |
| Ex. 1 | A1 | CuPc/binder = 5/100 | 780 | 88 | 17 | 6.4 | 2.7 |
| Ex. 2 | A2 | CuPc/binder = 10/100 | 780 | 79 | 7.5 | 2.7 | 2.7 |
| Ex. 3 | A3 | CuPc/binder = 25/100 | 780 | 70 | 3.3 | 0.92 | 3.6 |
| Ex. 4 | A4 | x-$H_2$Pc/binder = 25/100 | 850 | 76 | 3.7 | 1.5 | 2.6 |
| Ex. 5 | | | 780 | 50 | 0.85 | 0.15 | 5.6 |
| Ex. 6 | | | 650 | 50 | 0.89 | 0.15 | 5.9 |

CuPc: copper phthalocyanine
x-$H_2$Pc: x-form metal-free phthalocyanine
TiOPc: oxytitanium phthalocyanine
binder: binder resin As described above, the photoreceptor of the present invention is a negative charging electrophotographic photoreceptor having excellent performances with respect to digital light input (high-γ characteristics) and further having a long life and high stability which make the photoreceptor suitable for repetitions of use.

Obviously, numerous modifications and variations of the present invention are possible in light of the above teachings. It is therefore to be understood that within the scope of the appended claims, the invention may be practiced otherwise than as specifically described herein.

This application is based on Japanese application Hei 11-368905, filed Dec. 27, 1999, the entire contents of which are hereby incorporated by reference.

What is claimed is:

1. A negative charging electrophotographic photoreceptor, comprising:

an electroconductive substrate;

a charge generation layer disposed on said electroconductive substrate; and a charge transport layer disposed on said charge generation layer;

wherein said charge transport layer is in a homogeneous state; and wherein said charge generation layer comprises a light transmittance of at least 10% when measured with monochromatic light through a one micrometer film thickness of said charge generation layer.

2. The electrophotographic photoreceptor of claim 1, wherein said light transmittance is measured with a light that comprises a wavelength of 780 nm.

3. The electrophotographic photoreceptor of claim 1, wherein said light transmittance is measured with a light that is sufficient to discharge at least a portion of a surface of said photoreceptor when said surface has a negative surface potential.

4. The electrophotographic photoreceptor of claim 1, wherein light transmittance is at least 30%.

5. The electrophotographic photoreceptor of claim 1, wherein light transmittance is at least 60%.

6. The electrophotographic photoreceptor of claim 1, wherein light transmittance is at least 68%.

7. The electrophotographic photoreceptor of claim 1, comprising an $E_{50}/E_{10}$ ratio in the range of 1 to 6.

8. The electrophotographic photoreceptor of claim 1, comprising an $E_{50}/E_{10}$ ratio in the range of 1 to 5.

9. The electrophotographic photoreceptor of claim 1, wherein said charge generation layer has a thickness of 1 $\mu$m or larger.

10. The electrophotographic photoreceptor of claim 1, wherein said charge generation layer has a thickness of 2 to 8 $\mu$m.

11. The electrophotographic photoreceptor of claim 1, wherein said charge generation layer comprises a charge generation material and a binder resin.

12. The electrophotographic photoreceptor of claim 11, wherein said charge generation material is present in an amount of greater than zero to 40 parts by weight per 100 parts by weight of said binder resin.

13. The electrophotographic photoreceptor of claim 11, wherein said charge generation material is present in an amount of 10 to 35 parts by weight per 100 parts by weight of said binder resin.

14. The electrophotographic photoreceptor of claim 11, wherein said charge generation material comprises at least one selected from the group consisting of an organic pigment and a phthalocyanine compound.

15. The electrophotographic photoreceptor of claim 11, wherein said binder resin comprises a cured polymer.

16. The electrophotographic photoreceptor of claim 11, wherein said binder resin comprises at least one polymer resin selected from the group consisting of unsaturated polyester resin, epoxy resin, melamine resin, urethane resin, cured fluororesin, acrylic resin and photocured resin.

17. The electrophotographic photoreceptor of claim 1, wherein said charge transport layer has a thickness of 10 $\mu$m or larger.

18. The electrophotographic photoreceptor of claim 1, wherein said charge transport layer has a thickness of 10 to 100 $\mu$m.

19. The electrophotographic photoreceptor of claim 1, wherein said charge transport layer comprises a charge transport material that does not substantially penetrate into said charge generation layer.

20. The electrophotographic photoreceptor of claim 1, further comprising an undercoating layer disposed between said electroconductive substrate and said charge generation layer.

21. The electrophotographic photoreceptor of claim 1, further comprising a surface protective layer disposed on a surface of said photoreceptor.

22. A process for producing the electrophotographic photoreceptor of claim 1, comprising solvent coating said charge transport layer onto said charge generation layer, wherein said charge generation layer is insoluble in the solvent.

23. A method of forming an image, comprising exposing the electrophotographic photoreceptor of claim 1 to monochromatic light.

24. An electrophotographic apparatus, comprising the electrophotographic photoreceptor of claim 1.

25. The electrophotographic apparatus of claim 24, wherein said electrophotographic apparatus is a digital apparatus which forms an image through the step of forming a latent image by exposing the electrophotographic photoreceptor to light based on image signals which have been converted to digital data.

26. A negative charging electrophotographic photoreceptor, comprising:

an electroconductive substrate;

a charge generation layer disposed on said electroconductive substrate; and a charge transport layer disposed on said charge generation layer;

wherein said charge transport layer is in a homogeneous state; and wherein said photoreceptor comprises an $E_{50}/E_{10}$ ratio in the range of 1 to 6, when measured with monochromatic light.

27. The electrophotographic photoreceptor of claim 26, comprising an $E_{50}/E_{10}$, ratio in the range of 1 to 5.

28. An electrophotographic apparatus, comprising the electrophotographic photoreceptor of claim 26.

29. The electrophotographic apparatus of claim 28, wherein said electrophotographic apparatus is a digital apparatus which forms an image through the step of forming a latent image by exposing the electrophotographic photoreceptor to light based on image signals which have been converted to digital data.

30. A method of forming an image, comprising exposing the electrophotographic photoreceptor of claim 26 to light.

31. A negative charging electrophotographic photoreceptor, comprising:

an electroconductive substrate;

a charge generation layer disposed on said electroconductive substrate; and a charge transport layer disposed on said charge generation layer;

wherein said charge transport layer is in a homogeneous state; and wherein said charge generation layer comprises a light transmittance of at least 68% when measured with monochromatic light through a one micrometer film thickness of said charge generation layer.

32. The electrophotographic photoreceptor of claim 31, wherein said light transmittance is measured with a light that is sufficient to negatively charge said photoreceptor.

33. The electrophotographic photoreceptor of claim 32, wherein said light comprises a wavelength of 780 nm.

34. An electrophotographic apparatus, comprising the electrophotographic photoreceptor of claim 31.

35. The electrophotographic apparatus of claim 34, wherein said electrophotographic apparatus is a digital apparatus which forms an image through the step of forming a latent image by exposing the electrophotographic photoreceptor to monochromatic light based on image signals which has been converted to digital data.

36. A method of forming an image, comprising exposing the electrophotographic photoreceptor of claim 31 to monochromatic light.

37. An electrophotographic apparatus, comprising:

an electrophotographic photoreceptor; and a monochromatic exposure light, wherein said electrophotographic photoreceptor comprises:

an electroconductive substrate;

a charge generation layer disposed on said electroconductive substrate; and a charge transport layer disposed on said charge generation layer;

wherein said charge transport layer is in a homogeneous state; and wherein said charge generation layer comprises a light transmittance to said exposure light of at least 10% when measured with monochromatic light through a one micrometer film thickness of said charge generation layer.

38. A method of forming an image, comprising exposing the electrophotographic photoreceptor of claim 37 to said exposure light.

39. A method for preparing the negative charging electrophotographic photoreceptor as claimed in claim 1, comprising:

dissolving at least one charge generation material in at least one solvent to form a dissolved charge generation material;

contacting said dissolved charge generation material with at least one binder polymer to form a first coating fluid;

applying said first coating fluid to the electroconductive substrate;

drying and optionally curing the applied first coating fluid to obtain the charge generation layer;

dissolving at least one charge transport material in at least one solvent to form a dissolved charge transport material;

contacting said dissolved charge transport material with at least one binder polymer to form a second coating fluid;

applying said second coating fluid to the charge generation layer;

drying and optionally curing the applied second coating fluid to obtain the charge transport layer.

40. A method for preparing the negative charging electrophotographic photoreceptor as claimed in claim 26, comprising:

dissolving at least one charge generation material in at least one solvent to form a dissolved charge generation material;

contacting said dissolved charge generation material with at least one binder polymer to form a first coating fluid;

applying said first coating fluid to the electroconductive substrate;

drying and optionally curing the applied first coating fluid to obtain the charge generation layer;

dissolving at least one charge transport material in at least one solvent to form a dissolved charge transport material;

contacting said dissolved charge transport material with at least one binder polymer to form a second coating fluid;

applying said second coating fluid to the charge generation layer;

drying and optionally curing the applied second coating fluid to obtain the charge transport layer.

41. A method for preparing the negative charging electrophotographic photoreceptor as claimed in claim 31, comprising:

dissolving at least one charge generation material in at least one solvent to form a dissolved charge generation material;

contacting said dissolved charge generation material with at least one binder polymer to form a first coating fluid;

applying said first coating fluid to the electroconductive substrate;

drying and optionally curing the applied first coating fluid to obtain the charge generation layer;

dissolving at least one charge transport material in at least one solvent to form a dissolved charge transport material;

contacting said dissolved charge transport material with at least one binder polymer to form a second coating fluid;

applying said second coating fluid to the charge generation layer;

drying and optionally curing the applied second coating fluid to obtain the charge transport layer.

* * * * *